US005467825A

United States Patent [19]

Vallet

[11] Patent Number: 5,467,825

[45] Date of Patent: Nov. 21, 1995

[54] APPARATUS AND METHOD FOR HANGING COILED TUBING IN WELLS

[76] Inventor: Aldon J. Vallet, 129 Arbour Cliff Close, N.W., Calgary, Alberta, Canada, T3G 3W6

[21] Appl. No.: 332,109

[22] Filed: Oct. 31, 1994

[30] Foreign Application Priority Data

May 10, 1994 [CA] Canada ..... 2133724

[51] Int. Cl.[6] ..... E21B 19/00

[52] U.S. Cl. ..... 166/379

[58] Field of Search ..... 166/77, 85, 86, 166/96, 208, 379, 382, 384; 403/381

[56] References Cited

U.S. PATENT DOCUMENTS 3,690,381 9/1972 Slator et al. ..... 166/86 X
4,515,220 5/1985 Sizer et al. ..... 166/78 X
4,585,061 4/1986 Lyons et al. ..... 166/85 X
5,012,865 5/1991 McLeod ..... 166/90
5,103,900 4/1992 McLeod et al. ..... 166/88

*Primary Examiner*—Roger J. Schoeppel
*Attorney, Agent, or Firm*—Anthony R. Lambert

[57] ABSTRACT

A dognut for use in the installation of a string of coiled tubing in an oil or gas well features a construction and assembly which enables the dognut to be installed on the tubing, the dognut and tubing to be landed in place in the tubing spool, the dognut seal to be activated and the assembly of the dognut, dognut seal, tubing and tubing spool to be pressure tested for leakage prior to cutting the coiled tubing above the dognut and putting the wellhead under pressure from the producing formation. This dognut installation adds to the safety and ease of completing the coiled tubing installation in oil or gas wells.

8 Claims, 8 Drawing Sheets

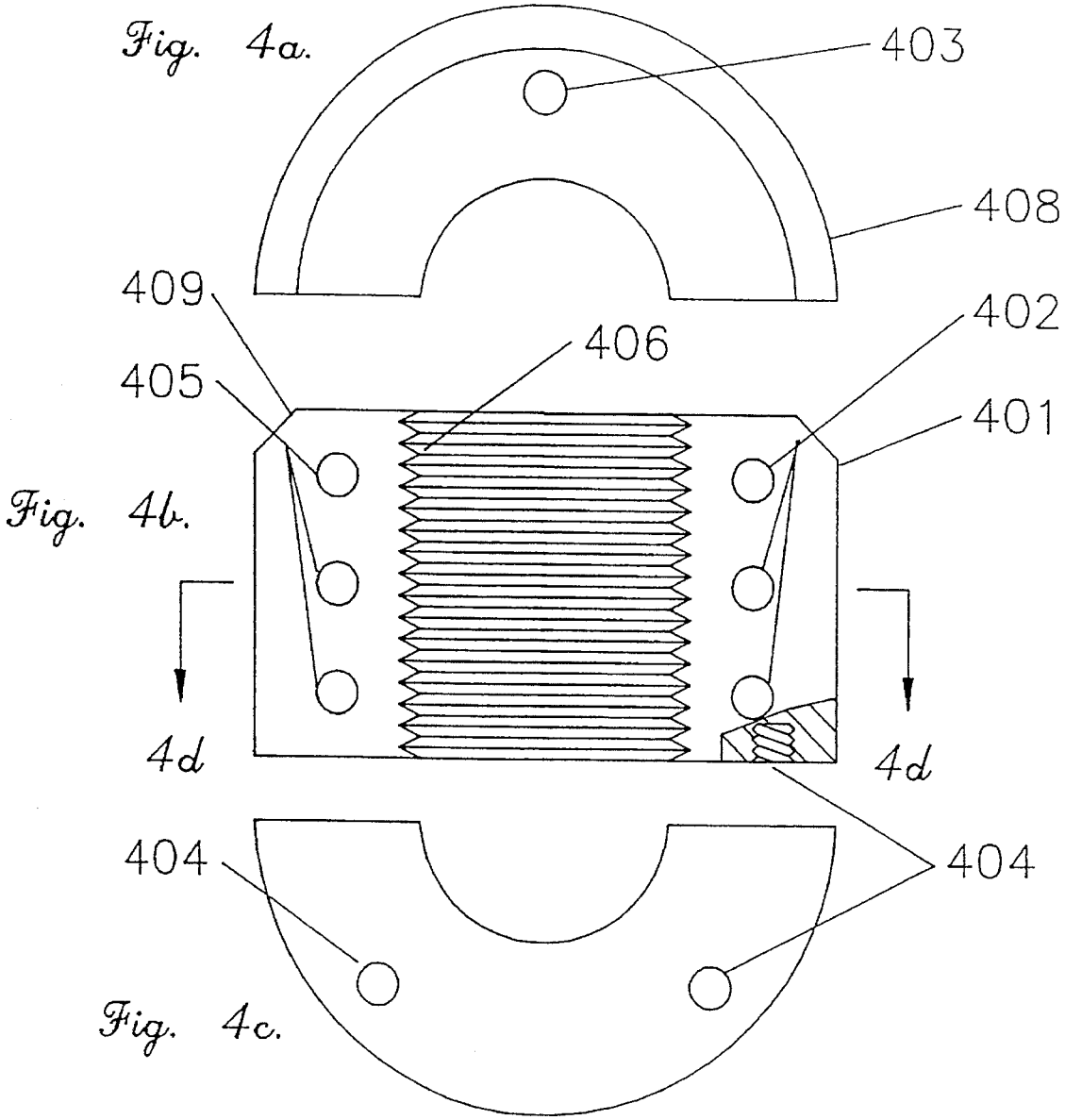
Fig. 4a.
403
408
409
405
406
402
401
Fig. 4b.
4d
4d
404
404
Fig. 4c.
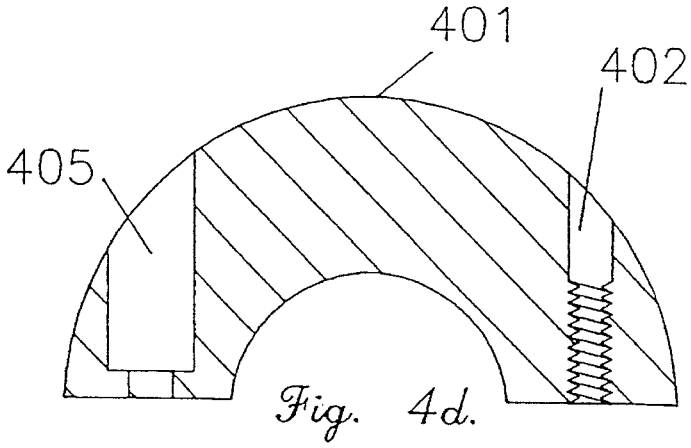
401
402
405
Fig. 4d.

APPARATUS AND METHOD FOR HANGING COILED TUBING IN WELLS

FIELD OF THE INVENTION

This invention relates to an apparatus and method for use in the installation of coiled tubing in oil and gas wells.

BACKGROUND OF THE INVENTION

In oil and gas wells which have been drilled and have casing installed there is generally a string of production tubing installed in the casing of the well. The fluid or gas from the producing formation travels up through this production tubing and is controlled by valves on the wellhead. In many conventional wells this tubing string is made from lengths of steel tubing screwed together to form a long string of production tubing. In many other wells, a coil of tubing generally described in the industry as coiled tubing is utilized. This tubing arrives at the well site in a large coil and is unrolled and inserted in the well with the appropriate equipment. Coiled tubing requires no screwed joints and results in considerable savings where it can be utilized. Both types of tubing generally require that they be held in position in the wellhead by a piece of equipment called a dognut. The upper end of the production tubing string attaches to the dognut and is positioned and locked into a tubing spool in the wellhead with special screws called dog screws or dogs. This operation is called landing the dognut and production tubing in the tubing spool.

In conventional wells, the dognut and production tubing landing operation is quite well known and requires that the last length of production tubing installed be of the right dimension so that the dognut will land in the correct place in the tubing spool. The upper end of the production tubing is generally held in the dognut by being screwed into the bottom of the dognut or an upset at the top end of the tubing is screwed onto the adapter of what is called a wrap-around dognut. This technology is standard practice.

In wells where coiled tubing is installed there is a problem with the termination of the coiled tubing in the dognut. When the coiled tubing is in place in the well it must be cut off and a thread cut on the exposed end (or some type of expanded portion made on this end of the coiled tubing, sometimes by welding) to hold the tubing in the dognut. The dognut is then landed in the tubing spool. The coiled tubing, although straightened by the coiled tubing injector mechanism, is not perfectly straight nor round and this leads to alignment problems when cutting and threading the coiled tubing and when landing the dognut. This problem is also evident when re-attaching to the tubing at later dates. Many times this work will be done with the well casing under pressure, adding to the complexity of the problems.

SUMMARY OF THE INVENTION

In one aspect, the invention comprises a dognut assembly composed of a split dognut, dognut seal and split dognut seal retainer-energizer. The metal parts are preferably constructed in halves so that the assembly of the three parts may be installed on the upper end of a length of coiled tubing which is positioned in an oil or gas well. This installation is done prior to cutting off the coiled tubing from the coiled tubing roll. The dognut seal associated with the split dognut is a resilient seal which is cut in such a way as to be installable on the coiled tubing at the same time as the assembly of the split dognut and dognut seal retainer-energizer is installed on the coiled tubing. The split dognut also preferably features teeth on the internal diameter which secure the coiled tubing in the split dognut.

Therefore there is provided in accordance with one aspect of the invention a split dognut assembly for use with coil tubing on a wellhead having a spool, the split dognut assembly comprising a split dognut having means to grip coil tubing; a split seal dimensioned to fit snugly between the spool and the coil tubing on one side of the split dognut, the seal being limited in movement by the split dognut; and means to provide axial compression on the seal towards the split dognut and force the seal into sealing engagement with the spool and coil tubing.

Preferably, the means to provide axial compression on the seal includes a seal energizer bolted onto the split dognut, the seal energizer having first and second sides, the first side facing the seal, and the second side including a first annular shoulder.

In a further aspect of the invention, the split dognut includes a second annular shoulder and the spool includes first and second sets of dognut screws, the first set of dognut screws being fastenable in engagement with-the first annular shoulder and the second set of dognut screws being fastenable in engagement with the second annular shoulder.

In a still further aspect of the invention, the split dognut includes a second annular shoulder and the spool includes a set of dognut screws, the set of dognut screws being fastenable in engagement with the second annular shoulder and the spool having a third annular shoulder dimensioned to receive the first annular shoulder and support the split dognut assembly in the spool.

There is also provided in a further aspect of the invention a method for the installation of coiled tubing in oil and gas wells using a split dognut mounted in a spool, the split dognut having means to grip the coiled tubing. In one aspect, the method includes the steps of: clamping the split dognut onto the coiled tubing; securing an expandable seal onto the coiled tubing with the expandable seal limited in movement in one direction by the split dognut; and compressing the expandable seal by force applied towards the split dognut into sealing engagement with the coiled tubing and the spool. The force may for example be provided by the weight of the coiled tubing or by sets of dognut screws fastenable in engagement with a first annular shoulder on a seal energizer abutting the expandable seal and a second annular shoulder on the split dognut.

Further elucidation of the invention will be found in the description that follows and in the claims.

BRIEF DESCRIPTION OF THE DRAWINGS

There will now be described a preferred embodiment of the invention, with reference to the drawings, by way of illustration, in which like numerals denote like elements and in which:

FIG. 4A is a top view of one half of a split dognut for coiled tubing according to the invention;

FIG. 4B is a partial cross section illustrating a bolt hole of the split dognut of FIG. 4A;

FIG. 4C is a bottom view of the split dognut of FIG. 4A;

FIG. 4D is a top view cross section of the coiled tubing split dognut of FIG. 4A;

DETAILED DESCRIPTION OF PREFERRED EMBODIMENTS

In this patent document, the split dognut seal retainer-energizer will be called the seal energizer and functions as a means to provide axial compression on the seal towards the split dognut and force the seal into sealing engagement with the spool and coil tubing. The dognut seal will be called the seal or split seal. The assembly of the split dognut, seal and seal energizer will be called the split dognut assembly. The tubing spool will be called the spool.

Figure 1:
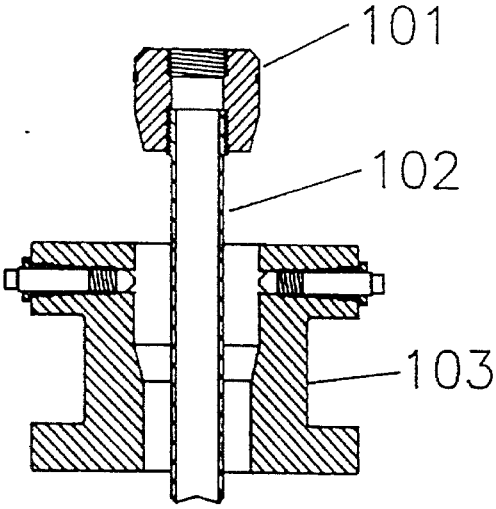
Fig. 1. Prior Art
FIG. 1 is a wellhead in circular cross section illustrating a simplified method of installing a dognut with conventional tubing (prior art)
Figure 1A:
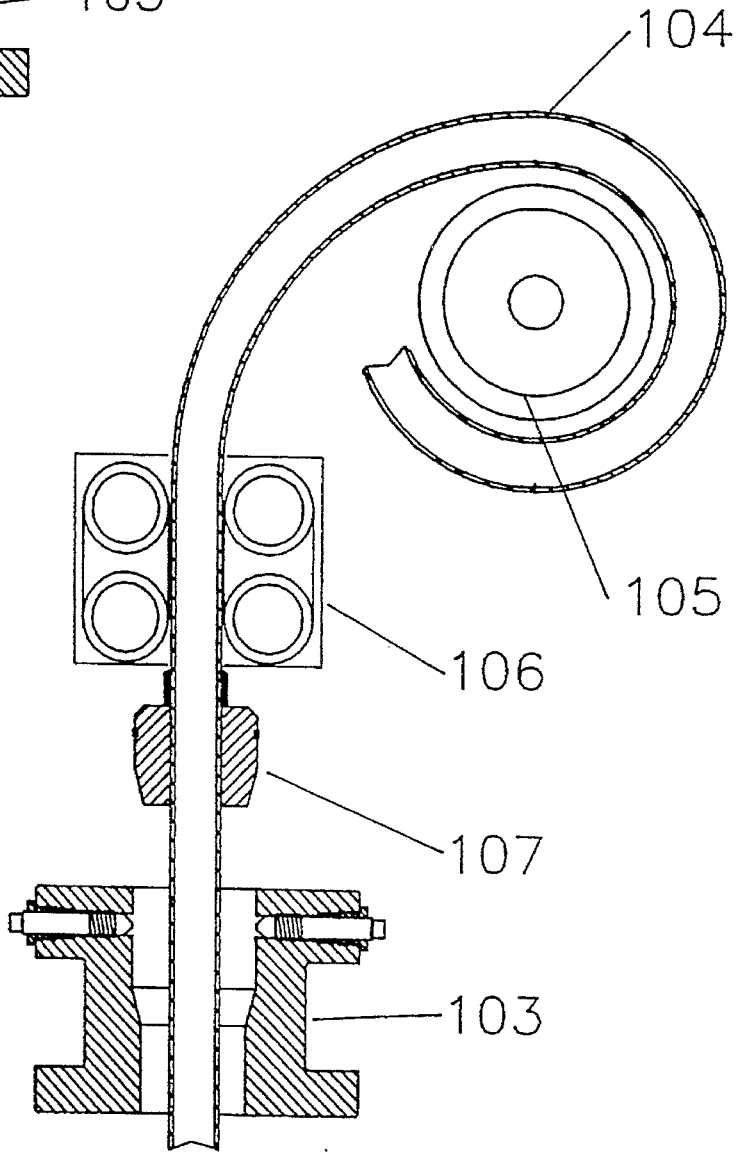
Fig. 1a. Prior Art
FIG. 1A is a wellhead in circular cross section illustrating the simplified method of installing a dognut with coiled tubing (prior art)

FIGS. 1, 1A, 2, 2A, 3 and 3A illustrate simplified existing methods of installing and holding the tubing in the wellhead. In FIG. 1 is shown a cross section of the dognut 101 with tubing 102 attached being lowered into spool 103. FIG. 1A illustrates the same procedure with coiled tubing 104 being unspooled from a reel 105 and straightened at 106. The dognut at 107 is not part of the prior art and is shown for reference only to show the position a split dognut would be in following the teachings of this patent document.

Figure 2:
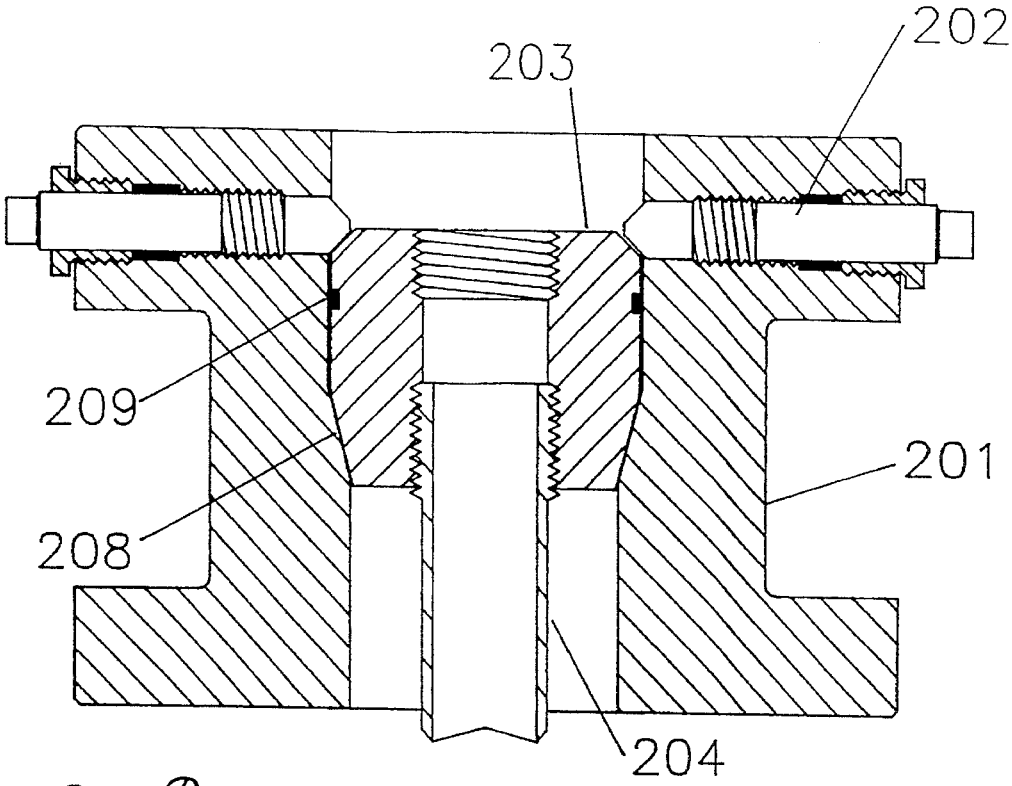
Fig. 2. Prior Art
FIG. 2 is a dognut for conventional tubing assembled in a tubing spool in side view circular cross section (prior art)
Figure 2A:
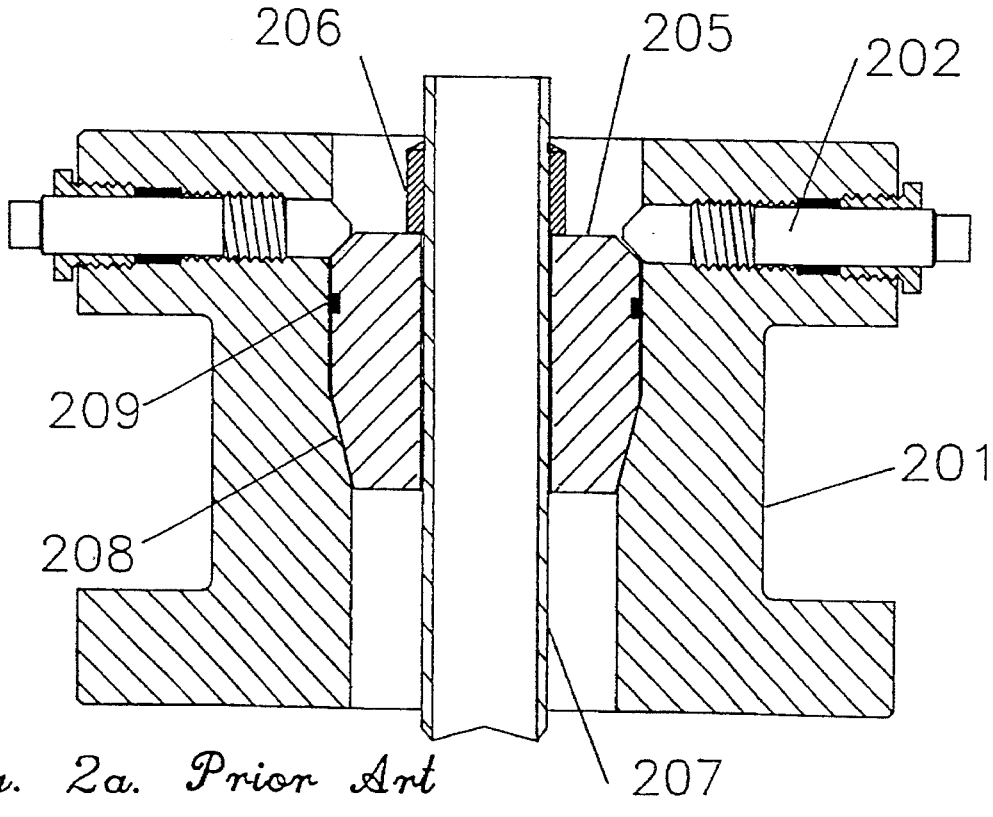
Fig. 2a. Prior Art
FIG. 2A is a dognut for conventional coiled tubing assembled in a tubing spool in side view circular cross section (prior art)

FIG. 2 illustrates a cross section of a standard tubing spool 201 with dognut 203 held in place by reduced diameter 208 and dogs 202. A dognut seal is noted at 209. Tubing 204 is threaded into and supported by the dognut 203. FIG. 2A illustrates a dognut as in FIG. 2 but with coiled tubing 207 extending through dognut 205 and being held in place in the dognut by threaded or welded collar 206.

Figure 3:
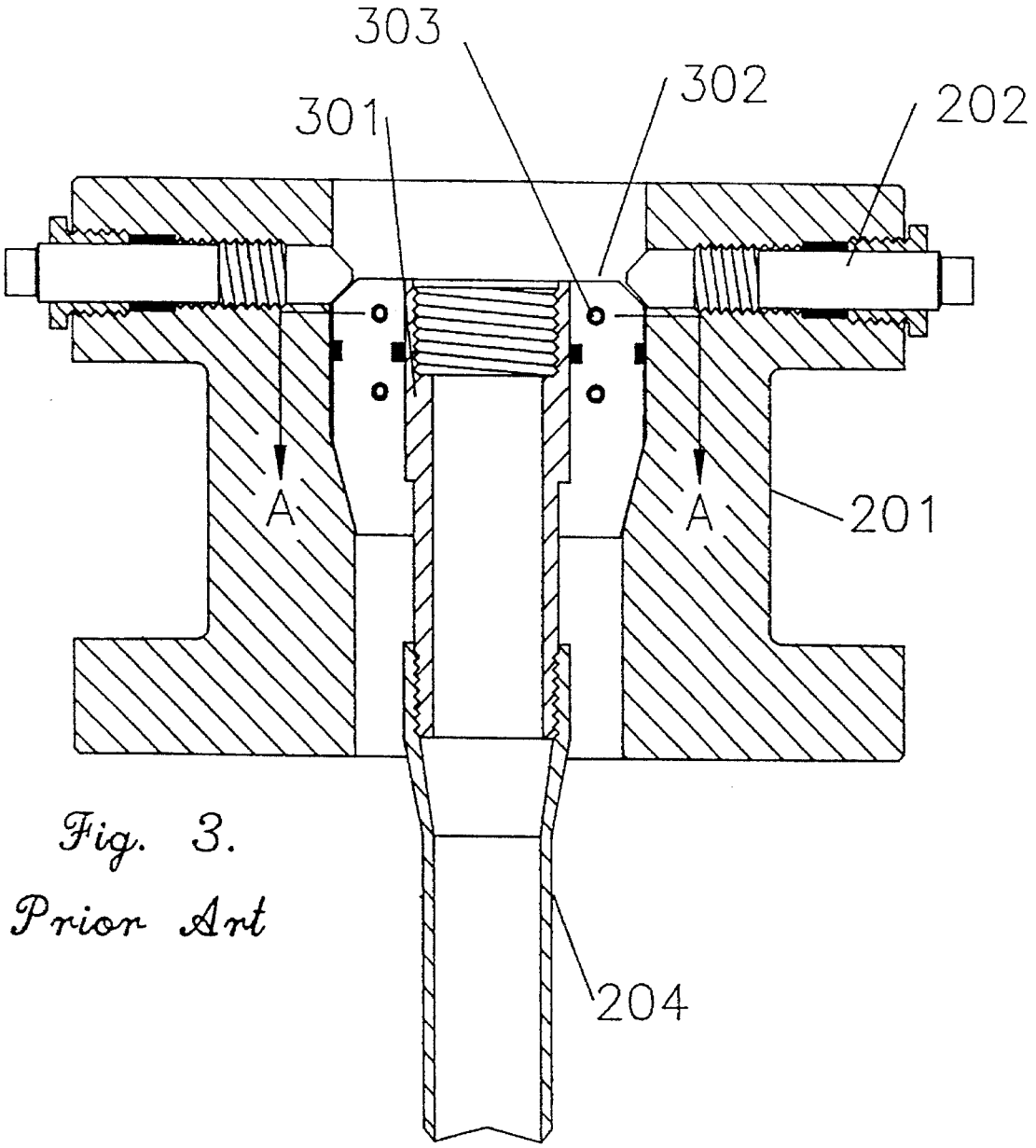
Fig. 3. Prior Art
FIG. 3 is a simplified representation of a wrap-around dognut for conventional tubing assembled in a tubing spool in side view circular cross section (prior art)
Figure 3A:
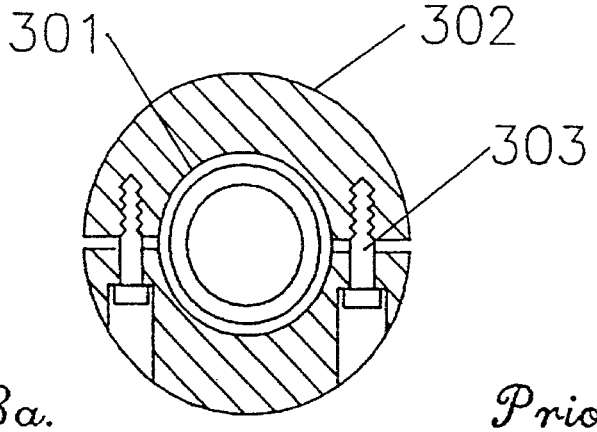
Fig. 3a. Prior Art
FIG. 3A is a top section view of the simplified wrap around dognut of FIG. 3 (prior art)

FIG. 3 shows a wrap-around dognut. This consists of a split dognut 302 clamped onto an threaded adapter 301 with through bolts 303. The tubing is threaded to and supported by the adapter 301. FIG. 3A illustrates a cross section of the split dognut of FIG. 3.

FIGS. 4A, 4B, 4C, 4D, 5A, 5B, 5C, 6A and 6B illustrate parts of an embodiment of the split dognut assembly for coiled tubing according to the invention. They consist in this instance of two halves of the split dognut shown in various views in FIGS. 4A–4D, two halves of the seal energizer shown in various views in FIGS. 5A, 5B and 5C and the seal shown in FIGS. 6A and 6B. Conventional bolts are used to bolt the assembly together through the bolt holes shown.

The split dognut of FIGS. 4A–4D illustrates a metallic split dognut half 401, clamping bolt thread holes 402, threaded lifting bolt holes 403, seal energizer retaining bolt threaded holes 404 and clamping bolt head holes 405 for holding the device together. Serrations 406 on the internal diameter of the split dognut half are generally called slips in the industry and will be referred to as such and act as means to grip the coiled tubing. Annular shoulder 409 is a reduced diameter angular portion on the top end of the split dognut which is used to assist in retaining the split dognut in the spool. The diameter of the slips, as is well known, conforms to the size of the coiled tubing to be installed in the dognut assembly. Outside diameter 408 conforms to the spool in which the dognut assembly will be installed. FIG. 4D shows the split dognut of FIGS. 4A–4C in cross section, illustrating clamping bolt thread holes 402 and clamping bolt head holes 405 in the dognut half 401.

Figure 5A:
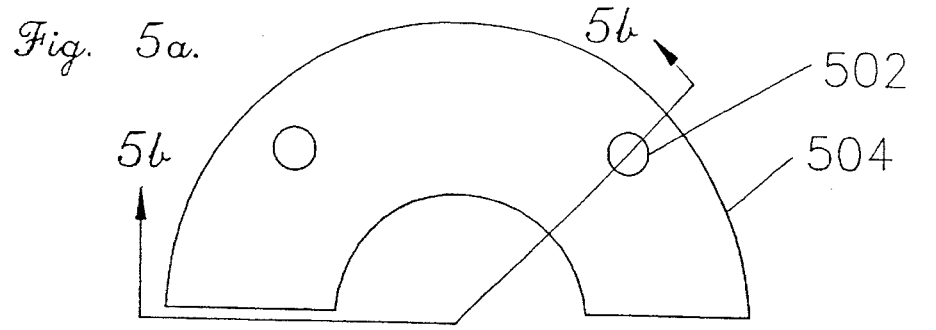
FIG. 5A is a top view of one half of a coiled tubing dognut seal retainer-energizer according to the invention.
Figure 5B:
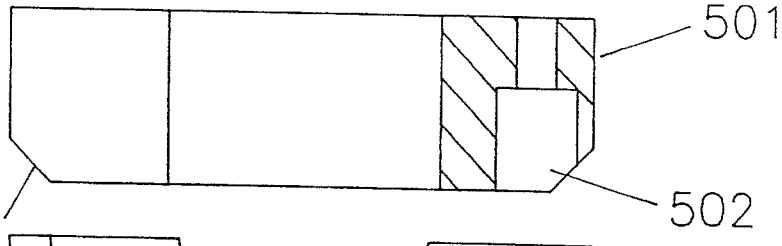
FIG. 5B is a side view in partial cross-section of the seal retainer-energizer of FIG. 5A.
Figure 5C:
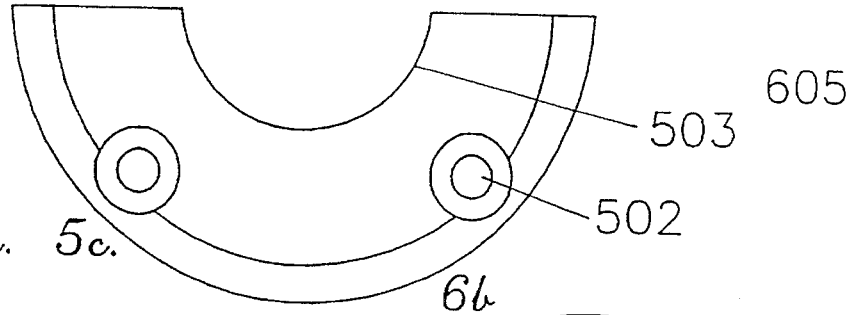
FIG. 5C is a bottom view of the seal retainer-energizer of FIG. 5A.

In FIGS. 5A, 5B and 5C is illustrated the metal seal energizer 501, with a partial cross section showing retaining bolt head holes 502 and inside diameter 503 which is larger than the diameter of the coiled tubing which will be in the center of the split dognut assembly. The retaining bolt head holes 502 match with the retaining bolt thread holes 404 in the dognut half 401. Annular shoulder 509 is a reduced diameter angular portion on the bottom end of seal energizer which is used to assist in retaining the seal energizer in the spool.

Figure 6A:
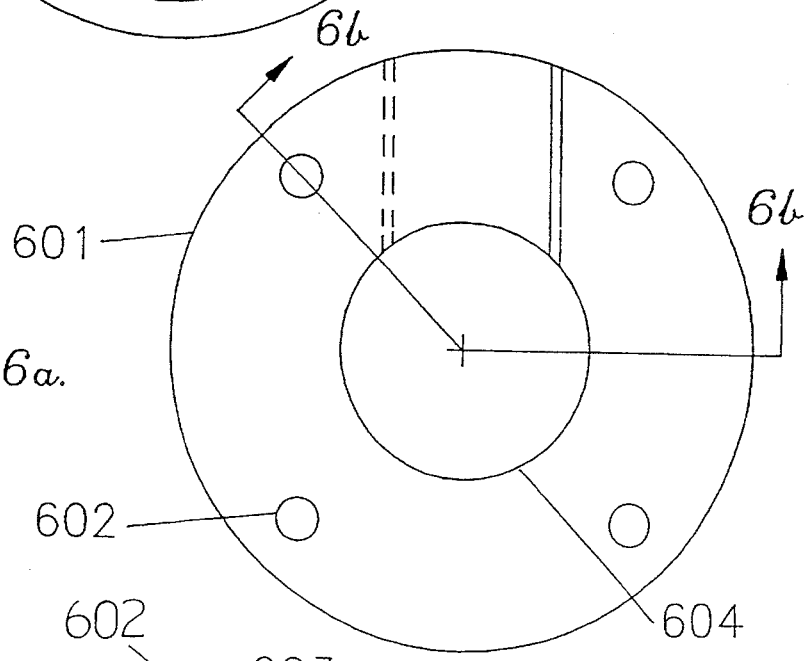
FIG. 6A is a top view in partial cross section of the dognut seal.
Figure 6B:
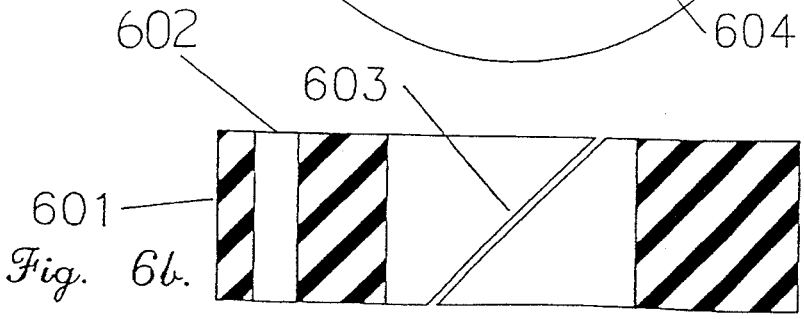
FIG. 6B is a section along the line 6B—6B in FIG. 6A.

FIGS. 6A and 6B illustrate the resilient seal 601 with outside diameter 605 which conforms to the spool size it will be fitted to, inside diameter 604 which will conform to the size of the coiled tubing it will be fitted around, retaining bolt holes 602 and angled split 603 which allows the seal to be slipped onto the coiled tubing.

The manufacture of the split dognut is preferably from a single piece of round steel bar, with all the machining, drilling and threading done prior to the bar being cut to give the two halves. The material removed by the cut will allow the split dognut to be clamped onto the coiled tubing when assembled.

Figure 7:
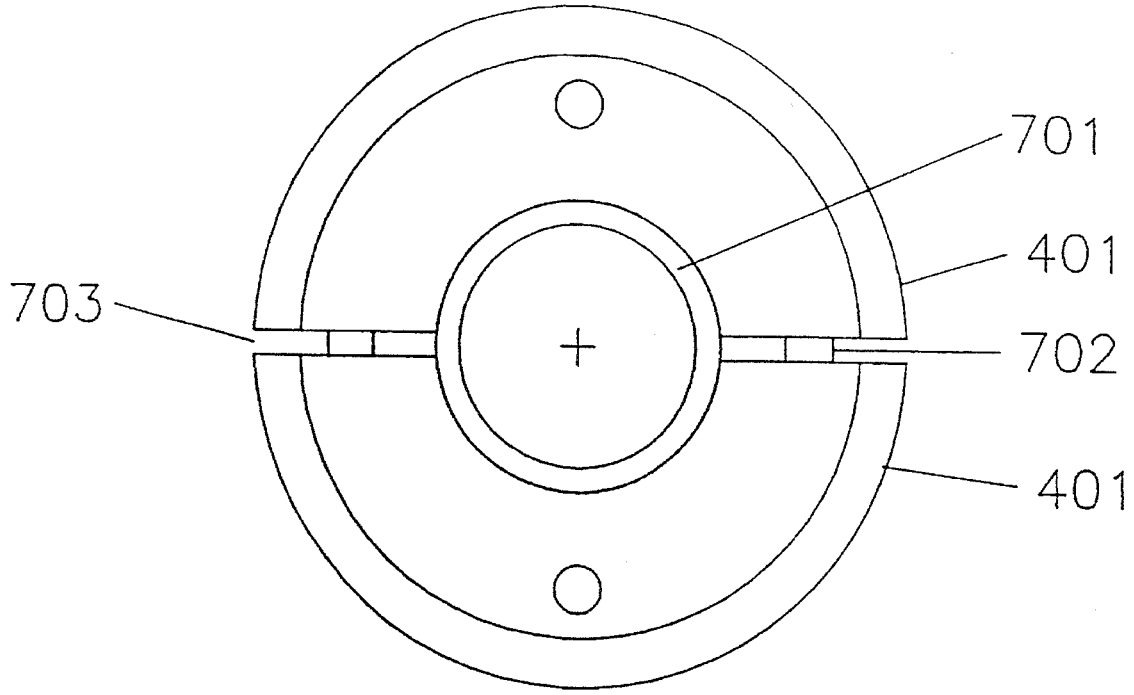
FIG. 7 is a top view of the split dognut installed on the coiled tubing.

FIG. 7 illustrates a top view of the split dognut clamped onto endless tubing 701 with clamping bolts 702 and gap 703 for pulling the two halves together with the clamping bolts.

Figure 8:
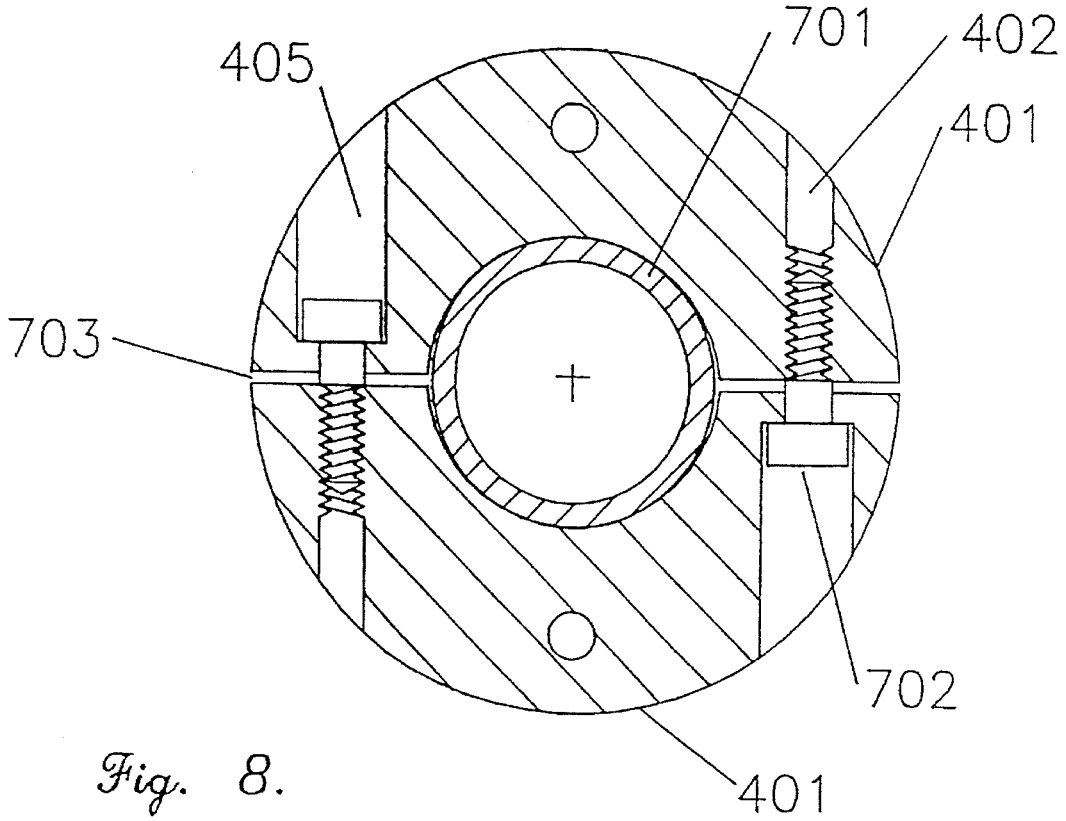
FIG. 8 is a top view cross section of the split dognut of FIG. 7 installed on the coiled tubing.

FIG. 8 shows the top view cross section of FIG. 7 and illustrates the location and function of paired clamping bolts 702.

Figure 9:
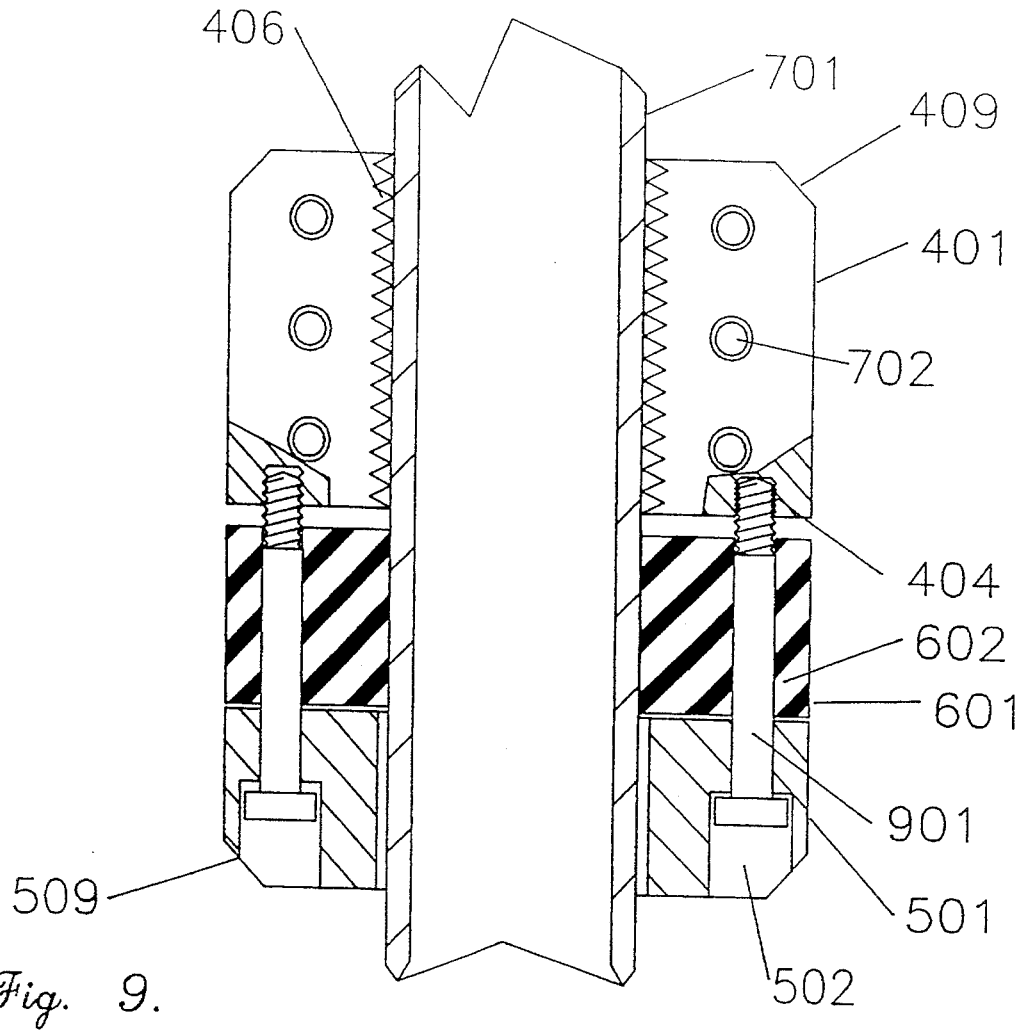
FIG. 9 is a side view circular cross section of the split dognut, dognut seal and seal retainer-energizer in place on a section of coiled tubing in the installed position.
Figure 10:
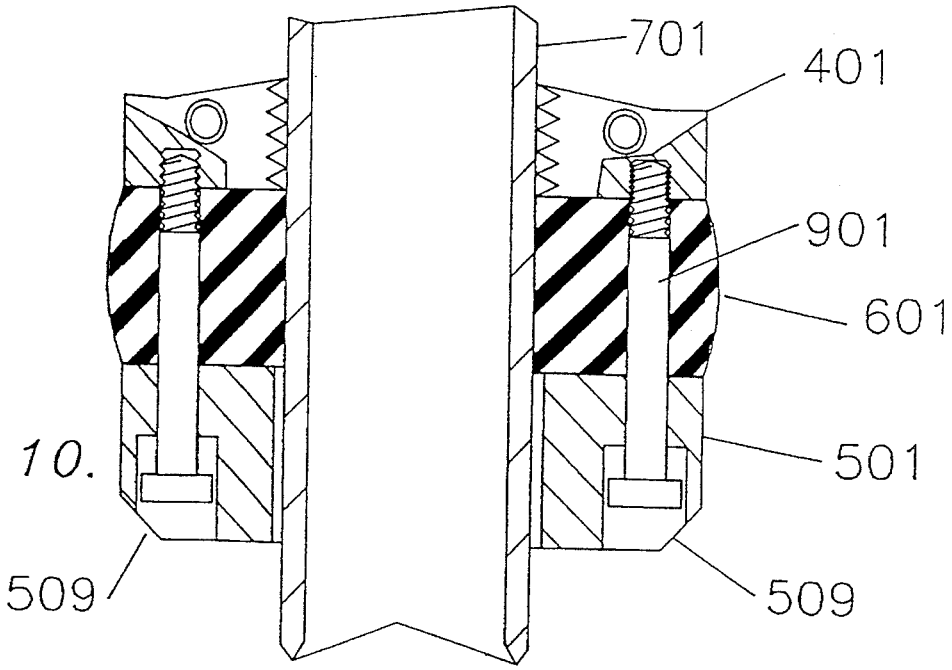
FIG. 10 is a side view circular cross section of the split dognut, dognut seal and seal retainer-energizer according to the invention in place on a section of coiled tubing in the dognut seal energized position.

The split dognut assembly in place on the coiled tubing is shown in side view circular section in FIG. 9. The split dognut 401 is clamped in place around the coiled tubing with clamping bolts and the action of the slips on the coiled tubing hold the split dognut 401 in place on the coiled tubing 701. The seal 602 is slipped onto the coiled tubing 701 and positioned and rotated so that the retaining bolt holes in the seal match the threaded retaining bolt holes in the split dognut halves. Fixing of the split dognut on the coiled tubing provides a limit to movement of the seal axially along the coiled tubing. The seal energizer halves 501 are then bolted in place with the retaining bolts 901. Note that the retaining bolts 901 are screwed in tightly but do not cause the seal to expand. The seal energizer halves 501 also have clearance on the inside diameter from the coiled tubing 701. The action of the seal energizer 501 on the seal 601 is shown in FIG. 10. When the seal energizer 501 is moved in an upward direction towards the split dognut, it compresses the resilient seal 601 and forces it outward and inward. Note that the seal energizer 501 rides up on the retaining bolts 901 so that it is axially slidable over a limited range of motion in relation to the split dognut.

Figure 11:
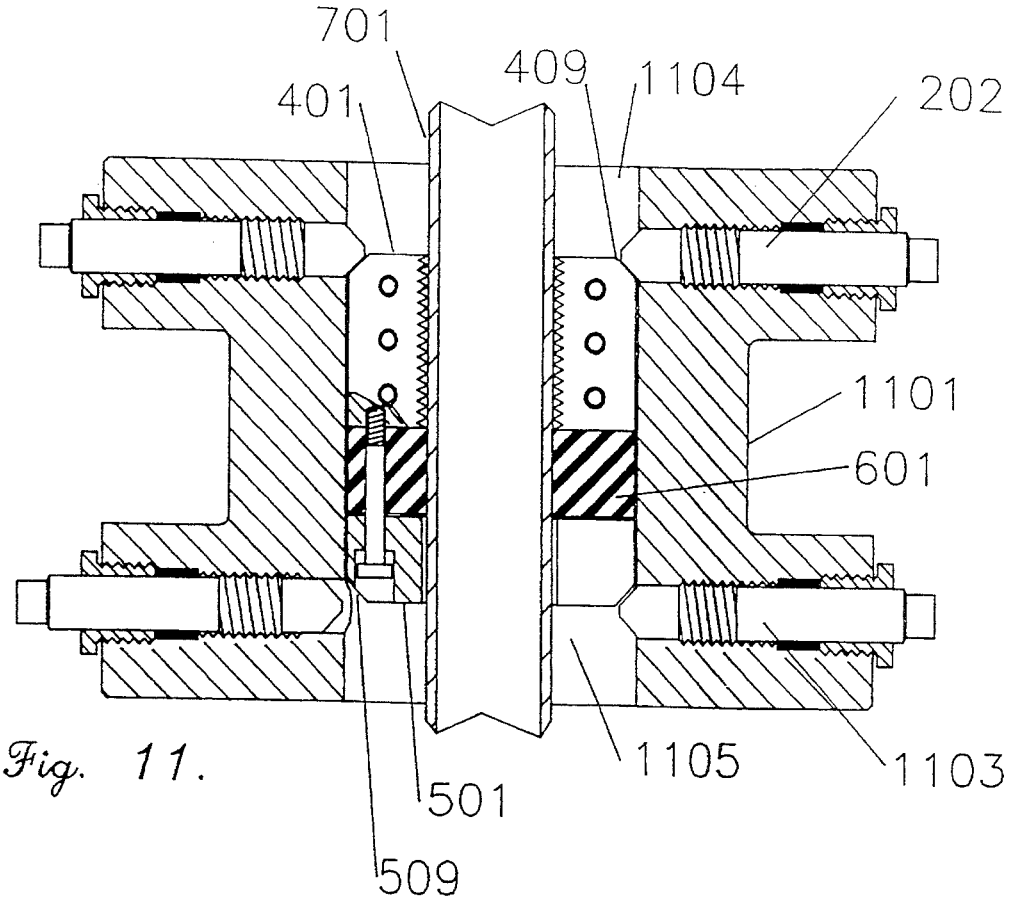
FIG. 11 is a side view circular cross section showing the split dognut, dognut seal and seal retainer-energizer according to the invention assembled on coiled tubing and installed in a dual dognut type spool.

When the split dognut assembly and the coiled tubing 701 are in place in the spool prior to energizing the seal 601, the configuration is as shown in FIG. 11. One type of spool, 1101, has an upper set of dogs 202 fastenable in engagement with the annular shoulder 409 of the split dognut, a lower set of dogs 1103 fastenable in engagement with the annular shoulder 509 of the seal energizer, an upper annular cavity 1104 and a lower annular cavity 1105. The split dognut assembly is restrained from moving in the upward direction by the upper set of dogs 202 and the action of turning in the lower set of dogs 1103 moves the seal energizer 501 upward and forces the seal 601 out against the inside surface of the spool and also forces the seal against the circumference of the coiled tubing 701. One of the lower dogs is 1103 illustrated turned in, while the other dog is still in the out position. When all the lower dogs have been turned in, the dognut seal effectively seals the upper annular cavity of the spool from the lower annular cavity.

Figure 12:
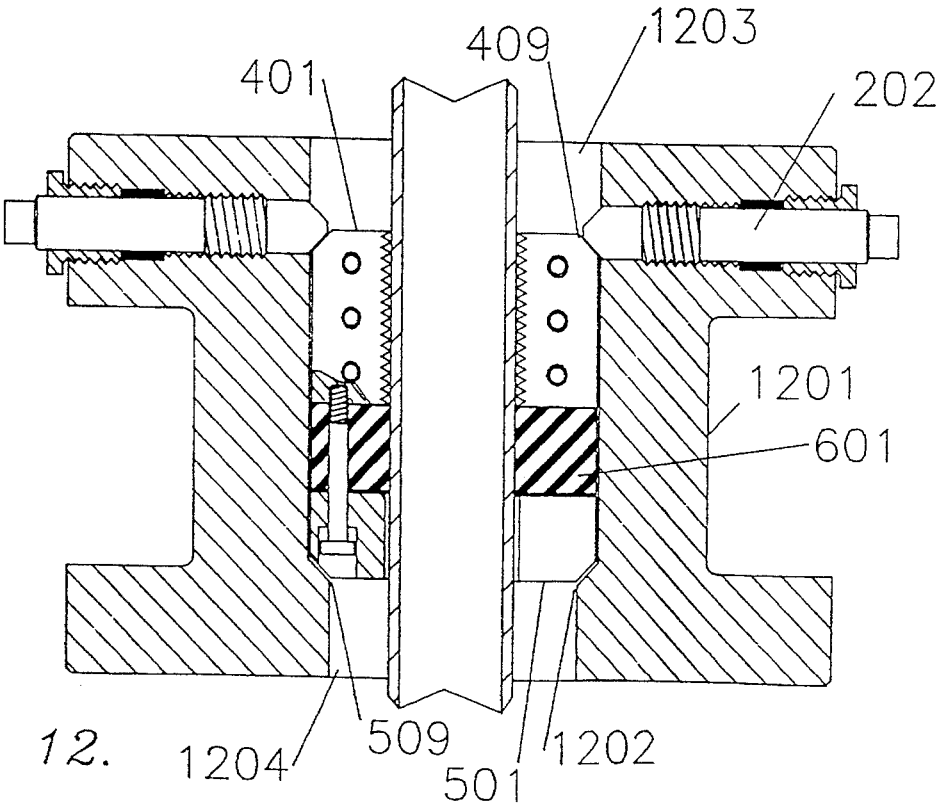
FIG. 12 is a is a side view circular cross section showing the split dognut, dognut seal and seal retainer-energizer according to the invention assembled on coiled tubing and installed in a standard type spool.

In a second spool configuration shown in FIG. 12, the spool 1201 features a reduced angular diameter or shoulder 1202, an upper annular cavity 1203 and a lower annular cavity 1204. This spool in itself is a somewhat standard configuration in the industry. The seal energizer of the split dognut assembly rests on the reduced diameter and the downward weight of the coiled tubing moves the seal energizer against the seal and forces the seal to expand against the inside diameter of the spool and on the outside diameter of the coiled tubing. The upper dogs lock the split dognut assembly in place. The upper annular cavity and lower annular cavity of the spool are thus isolated from each other and the coiled tubing is supported in the well. Pressure testing of the split dognut assembly in the spool can now be done. The coiled tubing will then be cut off and the wellhead equipment installed as shown in FIG. 13.

A person skilled in the art could make immaterial modifications to the invention described and claimed in this patent without departing from the essence of the invention. Without limiting the generality of the foregoing, such modifications might be the number of clamping bolts, the direction in which they are positioned, the split angle in the seal, and the manufacturing method of the parts. Similarly, while the split dognut assembly has been shown in a preferred orientation in the well, it could be inverted, but this is not preferred.

The embodiments of the invention in which an exclusive property or privilege is claimed are defined as follows:

1. A split dognut assembly for use with coil tubing on a wellhead having a spool, the split dognut assembly comprising:

a split dognut having means to grip coil tubing;

a split seal dimensioned to fit snugly between the spool and the coil tubing on one side of the split dognut, the seal being limited in movement by the split dognut; and means to provide axial compression on the seal towards the split dognut and force the seal into sealing engagement with the spool and coil tubing.

2. The split dognut assembly of claim 1 in which the means to provide axial compression on the seal includes a seal energizer axially slidable over a limited range of motion in relation to the split dognut, the seal energizer having first and second sides, the first side facing the seal, and the second side including a first annular shoulder.

3. The split dognut assembly of claim 2 in which the split dognut includes a second annular shoulder and the spool includes first and second sets of dognut screws, the first set of dognut screws being fastenable in engagement with the first annular shoulder and the second set of dognut screws being fastenable in engagement with the second annular shoulder.

4. The split dognut assembly of claim 2 in which the split dognut includes a second annular shoulder and the spool includes a set of dognut screws, the set of dognut screws being fastenable in engagement with the second annular shoulder and the spool having a third annular shoulder dimensioned to receive the first annular shoulder and support the split dognut assembly in the spool.

5. The split dognut assembly of claim 1 in which the means to grip the coiled tubing includes serrations on the inside of the split dognut.

6. A method of installing coiled tubing having a weight in a well using a split dognut mounted in a spool, the split dognut having means to grip the coiled tubing, the method comprising the steps of:

clamping the split dognut onto the coiled tubing;

securing an expandable seal onto the coiled tubing with the expandable seal limited in movement in one direction by the split dognut; and compressing the expandable seal by force applied towards the split dognut into sealing engagement with the coiled tubing and the spool.

7. The method of claim 6 in which the compression force is provided by the weight of the coiled tubing.

8. The method of claim 6 in which the compression force is provided by at least one set of dognut screws fastenable in engagement with a first annular shoulder on a seal energizer abutting the expandable seal and a second annular shoulder on the split dognut.

* * * * *